US005609139A

United States Patent [19]

Ueda et al.

[11] Patent Number: 5,609,139

[45] Date of Patent: Mar. 11, 1997

[54] FUEL FEED CONTROL SYSTEM AND METHOD FOR INTERNAL COMBUSTION ENGINE

[75] Inventors: Katsunori Ueda; Toyoaki Fukui, both of Kyoto-fu; Satoshi Yoshikawa, Shiga-ken, all of Japan

[73] Assignee: Mitsubishi Jidosha Kogyo Kabushiki Kaisha, Tokyo, Japan

[21] Appl. No.: 593,172

[22] Filed: Feb. 1, 1996

Related U.S. Application Data

[63] Continuation of Ser. No. 405,985, Mar. 17, 1995, abandoned.

[30] Foreign Application Priority Data

Mar. 18, 1994 [JP] Japan ..... 6-049167

[51] Int. Cl.[6] ..... E02M 51/00

[52] U.S. Cl. ..... 123/492

[58] Field of Search ..... 123/492, 491, 123/339.1, 435

[56] References Cited

U.S. PATENT DOCUMENTS

| | | | |
|---|---|---|---|
| 5,345,908 | 9/1994 | Nishimura et al. | 123/339.1 |
| 5,390,641 | 2/1995 | Yamada et al. | 123/491 |
| 5,394,849 | 3/1995 | Tomisawa | 123/435 |
| 5,423,208 | 6/1995 | Dudek et al. | 123/492 |
| 5,441,030 | 8/1995 | Satsukawa | 123/491 |

FOREIGN PATENT DOCUMENTS

| | | | |
|---|---|---|---|
| 419377 | 3/1992 | Japan | 123/492 |

OTHER PUBLICATIONS

English Abstract, Japanese Patent Publ. Laid Open (Kokai) No. Sho 59–15656, Jan. 26, 1984.

Hasegawa, Shiyunpei, English Abstract of JP HEI 4–19377, Jan. 26, 1984.

*Primary Examiner*—Raymond A. Nelli

[57] ABSTRACT

A fuel feed control system and method for an internal combustion engine is provided with a device for setting the quantity of fuel and a fuel injector for feeding fuel in accordance with the fuel quantity set by the fuel quantity setting device. The fuel quantity setting device is provided with a device for estimating the quantity of air to be inducted on the basis of the result of detection of the quantity of inducted air at an inducted air quantity detection time, inducted air quantity information detected before the inducted air quantity detection time and predicted information. The inducted air quantity estimation device is provided with a device for changing the predicted information so that, when a transient operation state of the engine is detected by a transient operation state detector, the estimated quantity of inducted air and a real quantity of inducted air become closer to each other. The control system permits setting of an accurate injection quantity of fuel by precisely measuring a quantity of inducted air even when the state of operation of the engine is in a transition period.

28 Claims, 10 Drawing Sheets

LINEAR INCREASE IN INDUCTED AIR QUANTITY

NON-LINEAR INCREASE IN INDUCTED AIR QUANTITY

FUEL FEED CONTROL SYSTEM AND METHOD FOR INTERNAL COMBUSTION ENGINE

This application is a continuation of application Ser. No. 08/405,985, filed on Mar. 17, 1995, now abandoned.

BACKGROUND OF THE INVENTION

1. Field of the Invention

This invention relates to a fuel feed control system suitable for use with an internal combustion engine mounted on an automotive vehicle, and especially to a fuel feel control system which, even when the state of operation of the engine is in a transition period, permits setting of an accurate injection quantity of fuel by precisely measuring a quantity of inducted air.

2. Description of the Related Art

In an internal combustion engine equipped with fuel injectors, the quantity of inducted air is generally detected, for example, by an air flow sensor and the quantity of fuel to be injected is then determined in accordance with the quantity of inducted air, whereby the air/fuel ratio (A/F) is controlled.

Since the injection of fuel in a 4-cycle engine is generally performed before the end of each induction stroke, information on the quantity of inducted air (A/N: the quantity of air inducted per revolution of a crankshaft of the engine) to determine the quantity of fuel to be injected is sampled at a time before the actual induction stroke. Described specifically, the quantity of fuel is determined, as shown in FIG. 9, based on a detected value of the quantity of air inducted about two strokes before the end of induction of air at which a real quantity of inducted air is determined.

FIG. 10 is a graph showing a relationship between detected values of inducted air quantities and real quantities of inducted air. In the graph, a line a represents A/N ratios detected by an air flow sensor. The point designated by each dot shows the value of an A/N ratio estimated from the pressure of inducted air when an engine is operated in a steady state, and indicates a real quantity of inducted air without any detection lag or the like.

As is shown in this graph, it is appreciated that each A/N ratio detected by the air flow sensor (line a) is shifted from the corresponding real A/N value indicated by a dot.

In the graph, a line b has been drawn by advancing by two strokes (360°) the results of the detected A/N values indicated by the line a. When the line a is advanced by two strokes as indicated by the line b, the detected A/N values coincide with the corresponding real A/N values. In other words, the detection of each quantity of inducted air is delayed by two strokes. Incidentally, a line c indicates openings of a throttle valve.

If the quantity of fuel to be injected is determined based on the detected value of the quantity of air inducted two strokes before, the difference between the real quantity of inducted air and the quantity of inducted air detected based on the preceding sampling becomes greater during a transition period of operation state of the engine. This means, for example, that a real quantity of inducted air becomes greater than a corresponding detected value upon acceleration but the real quantity of inducted air becomes smaller than the corresponding detected value upon deceleration.

For accurate air/fuel ratio control, it is an essential requirement to detect a real quantity of inducted air accurately without a delay. In actuality, however, it is very difficult to avoid a lag in the detection of a quantity of inducted air because fuel is injected before induction of air into a combustion chamber is completed.

Known as a method for compensating this detection lag is the differential predictive correction method which makes use of the difference between a latest detection value and a preceding detection value. A calculation formula for a quantity of inducted air by the differential predictive correction method can be illustrated as shown below.

$$A/NF(n)=A/N(n)+m\cdot[A/N(n)-A/N(n-1)]$$

where

A/NF(n): Predicted value in the current control.

A/N(n): Detected value of the quantity of inducted air in the current control.

A/N(n−1): Detected value of the quantity of inducted air in the preceding control.

m: Prediction gain.

Here, the prediction gain m is defined as a constant which is determined by the difference in timing between the detection and the end of the induction stroke (m is 1 to 2 usually).

It is, however, rare that upon actual acceleration of an engine, the quantity of inducted air linearly increases as shown in FIG. 11A. Where the engine is accelerated causing a non-linear increase in inducted air such as shown by the non-linear line in FIG. 11B, use of a fixed value as the prediction gain m tends to result in insufficient prediction especially in an initial stage of acceleration.

However any attempt to positively perform a correction by increasing the prediction gain m then leads to amplification of minute changes in the detected value of the quantity of inducted air during steady state operation so that the quantity of fuel fluctuates. This results in the potential problem that the A/F ratio varies to induce misfire or fluctuations in torque.

Examples of techniques for making it possible to change the prediction gain include the technique disclosed in Japanese Patent Publication (Kokoku) No. HEI 4-19377. This technique is to set a gain on the basis of the state of operation of an engine by determining whether or not the operation state of the engine is an idling state. When the operation state of the engine is determined to be an idling state, the gain is set at a predetermined value $\phi_1$ conforming with characteristics of the idling state of the engine. When the operation state of the engine is not determined to be an idling state, the gain is then set at another predetermined value $\phi_2$.

In a fuel feed control system designed to permit changing of the prediction gain as mentioned above, however, the prediction gain for the estimation of a quantity of inducted air is set only at two values, one being a gain (the predetermined value $\phi_1$) for an idling state and the other a gain (the predetermined value $\phi_2$) for operation states other than idling. The fuel feed control system is therefore accompanied by the problem that, during normal operation other than idling, the gain is fixed at the predetermined value $\phi_1$ and changes in A/F, torque and the like cannot be reduced surely.

SUMMARY OF THE INVENTION

With the foregoing in view, the present invention has as a primary object the provision of a fuel feed control system for an internal combustion engine, which even when the state of operation of the engine is in a transition period, permits setting of an accurate injection quantity of fuel by precisely measuring a quantity of inducted air.

In one aspect of the present invention, there is thus provided a fuel feed control system for a multi-cylinder internal combustion engine, comprising:

fuel quantity setting means for setting a quantity of fuel to be fed at a desired fuel feeding time in an induction stroke of the internal combustion engine on the basis of inducted air quantity information detected at a desired inducted air quantity detection time before an end of the induction stroke, and means for feeding, at the desired fuel feeding time, fuel in the quantity set by the fuel quantity setting means;

wherein said fuel quantity setting means is provided with inducted air estimation means for estimating information on a quantity of air, which is to be inducted during the induction stroke corresponding to the desired fuel feeding time, on the basis of a result of detection of an inducted air quantity at the desired inducted air quantity detection time and inducted air quantity information detected before the desired inducted air quantity detection time and predicted information, and said inducted air estimation means is provided with transient operation state detection means for detecting a transient operation state of the internal combustion engine and means for changing the predicted information so that, upon detection of the transient operation state of the internal combustion engine by said transient operation state detection means, the estimated quantity of inducted air and a corresponding real quantity of inducted air become closer to each other.

According to the fuel feed control system of the present invention, the quantity of fuel to be fed at the desired fuel feeding time in the induction stroke is first set by the fuel quantity setting means on the basis of the inducted air quantity information detected at the desired inducted air quantity detection time before the end of the induction stroke.

At this time, the inducted air estimation means, which the fuel quantity setting means is provided with, estimates the quantity of air to be inducted during the induction stroke including the fuel feeding time based on the result of the detection of the inducted air quantity at the inducted air quantity detection time, the inducted air quantity information detected before the inducted air quantity detection time and the predicted information.

Further, when the transient operation state of the internal combustion engine is detected by the transient operation state detection means which the inducted air quantity estimation means is provided with, the predicted information is changed by the predicted information changing means so that the estimated quantity of inducted air and the real quantity of inducted air become closer to each other.

By the fuel feeding means, fuel is then fed at the fuel feeding time in accordance with the fuel quantity set by the fuel quantity setting means.

Owing to the features described above, it is possible to accurately estimate the quantity of air to be inducted and hence to set an accurate quantity of fuel to be injected even when the operation state of the engine is in the transition period. This has made it possible to suppress fluctuations in the air/fuel ratio during transient operation and thus to prevent misfire or fluctuations in torque.

The predicted information changing means may comprise means for changing the predicted information in accordance with the result of a comparison between the estimated quantity of inducted air and the corresponding real quantity of inducted air upon detection of the transient operation state of the internal combustion engine by the transient operation state detection means. This construction permits feedback of the predicted information, whereby the quantity of inducted air to be estimated next can be accurately estimated.

The predicted information changing means may comprise means for setting, as an initial value of the predicted information, a value greater than a number of detections of the quantity of inducted air between the desired inducted air quantity detection time and the desired fuel feeding time when the transient operation state of the internal combustion engine is detected by the transient operation state detection means. This construction permits setting the initial value at a value conforming with the internal combustion engine.

The predicted information changing means may comprise means for changing the predicted information in accordance with the result of a comparison between the estimated quantity of inducted air and the corresponding real quantity of the inducted air after a value greater than a number of detections of the quantity of inducted air between the desired inducted air quantity detection time and the desired fuel feeding time has been set as an initial value of the predicted information subsequent to detection of the transient operation state of the internal combustion engine by the transient operation state detection means. According to this construction, the difference between the estimated quantity value of inducted air and the real quantity of inducted air in the transition period of the internal combustion engine, especially upon estimation of the quantity of inducted air in an initial stage of acceleration can be reduced so that the feeding of fuel can be performed accurately.

Further, the predicted information changing means may comprise means for setting the initial value of the predicted information in accordance with at least one of a quantity and direction of a transient change of the internal combustion engine when the value greater than the number of detections of the quantity of inducted air between the desired inducted air quantity detection time and the desired fuel feeding time is set as the initial value of the predicted information upon detection of the transient operation state of the internal combustion engine by the transient operation state detection means. In this case, the predicted information can be set depending on the state in the transition period of the internal combustion engine.

The predicted information changing means may comprise means for changing and correcting the predicted information in a direction opposite to the direction of a preceding change and correction when the difference between the corresponding real quantity of the inducted air and the estimated quantity of inducted air becomes smaller than a predetermined positive value upon changing the predicted information in accordance with the result of a comparison between the estimated quantity of inducted air and the corresponding real quantity of inducted air subsequent to the detection of the transient operation state of the internal combustion engine by the transient operation state detection means. According to this construction, the predicted information can be promptly changed to enable accurate estimation of the quantity of inducted air even when the internal combustion engine is brought into the steady-state operation state from the transient operation state.

The predicted information changing means may comprise means for stepwise changing a rate of decrease of the predicted information in at least two stages upon changing the predicted information in a decreasing direction. By this construction, the predicted information can be promptly decreased to reduce an error in the estimation of the quantity of inducted air when the estimated quantity of inducted air is set greater than the real quantity of inducted air.

In addition, the inducted air quantity estimation means may comprise the transient operation state detection means, means for detecting a high-load operation state of the internal combustion engine, the predicted information changing means, and prediction inhibiting or low-gain setting means for setting the predicted information at 0 or at a predetermined low value and prohibiting the changing operation for the predicted information performed by the predicted information changing means when a high-load operation state of the internal combustion engine is detected by the high-load operation state detection means. This construction makes it possible to reduce, in a high-load operation state, an estimation error which may be produced under the influence of pulsation in inducted air.

The predicted information changing means may be provided with means for setting a lower limit of the predicted information so that the lower limit is varied depending on the result of the comparison between the estimated quantity of inducted air and the corresponding real quantity of inducted air, and the lower limit setting means comprises means for setting as the lower limit a value in a range not greater than a number of detections of the quantity of inducted air between the desired inducted air quantity detection time and the desired fuel feeding time. Since the lower limit is determined depending on the type of the engine according to this construction, it is possible to set the lower limit at a value conforming with the type of the internal combustion engine.

The predicted information changing means may be provided with means for setting an upper limit for the predicted information which varies depending on the result of the comparison between the estimated quantity of inducted air and the corresponding real quantity of inducted air. According to this construction, the changing of the predicted information can be promptly effected even when the transient operation state of the internal combustion engine changes from quick acceleration to quick deceleration.

The upper limit setting means may set the upper limit at different values depending on whether the internal combustion engine is in acceleration or in deceleration. This construction makes it possible to set the upper limit at a value conforming with an operation state of the internal combustion engine.

Further the inducted air estimation means estimates the inducted air quantity information during the induction stroke, including the desired fuel feeding time, on the basis of the detection result of the quantity of inducted air at the desired inducted air quantity detection time and a value obtained by incorporating the predicted information into a difference between the detection result of the quantity of inducted air at the desired inducted air quantity detection time and the inducted air quantity information detected before the desired inducted air quantity detection time. According to this construction, it is possible to accurately estimate the quantity of air to be inducted and hence to set an accurate quantity of fuel to be injected even when the operation state of the engine is in a transition period. This makes it possible to suppress fluctuations in the air/fuel ratio during transient operation and thus to prevent misfire or fluctuations in torque.

Moreover, the inducted air estimated means estimates the inducted air quantity information during the induction stroke, including the desired fuel feeding time, on the basis of the detection result of the quantity of inducted air at the desired inducted air quantity detection time and a value obtained by incorporating the predicted information into a difference between plural pieces of information on changes in the quantity of inducted air detected before the desired inducted air quantity detection time. According to this construction, the quantity of air to be inducted can be estimated more accurately to permit setting the quantity of fuel, which is to be injected, more finely and accurately even when the state of operation of the engine is in a transition period. Fluctuations in the air/fuel ratio during transient operation can therefore be suppressed, thereby making it possible to obtain smooth engine operation characteristics.

BRIEF DESCRIPTION OF THE DRAWINGS

FIGS. 11A and 11B are graphs schematically showing changes in the quantity of air inducted in an internal combustion engine, in which FIG. 11A shows a graph where the quantity of inducted air increases linearly while FIG. 11B depicts a graph where the quantity of inducted air increases non-linearly.

DESCRIPTION OF THE PREFERRED EMBODIMENT

The fuel feed control system according to an embodiment of the present invention for an internal combustion engine will hereinafter be described with reference to the accompanying drawings. Reference will first be made to FIG. 1 to FIG. 7.

Figure 3:
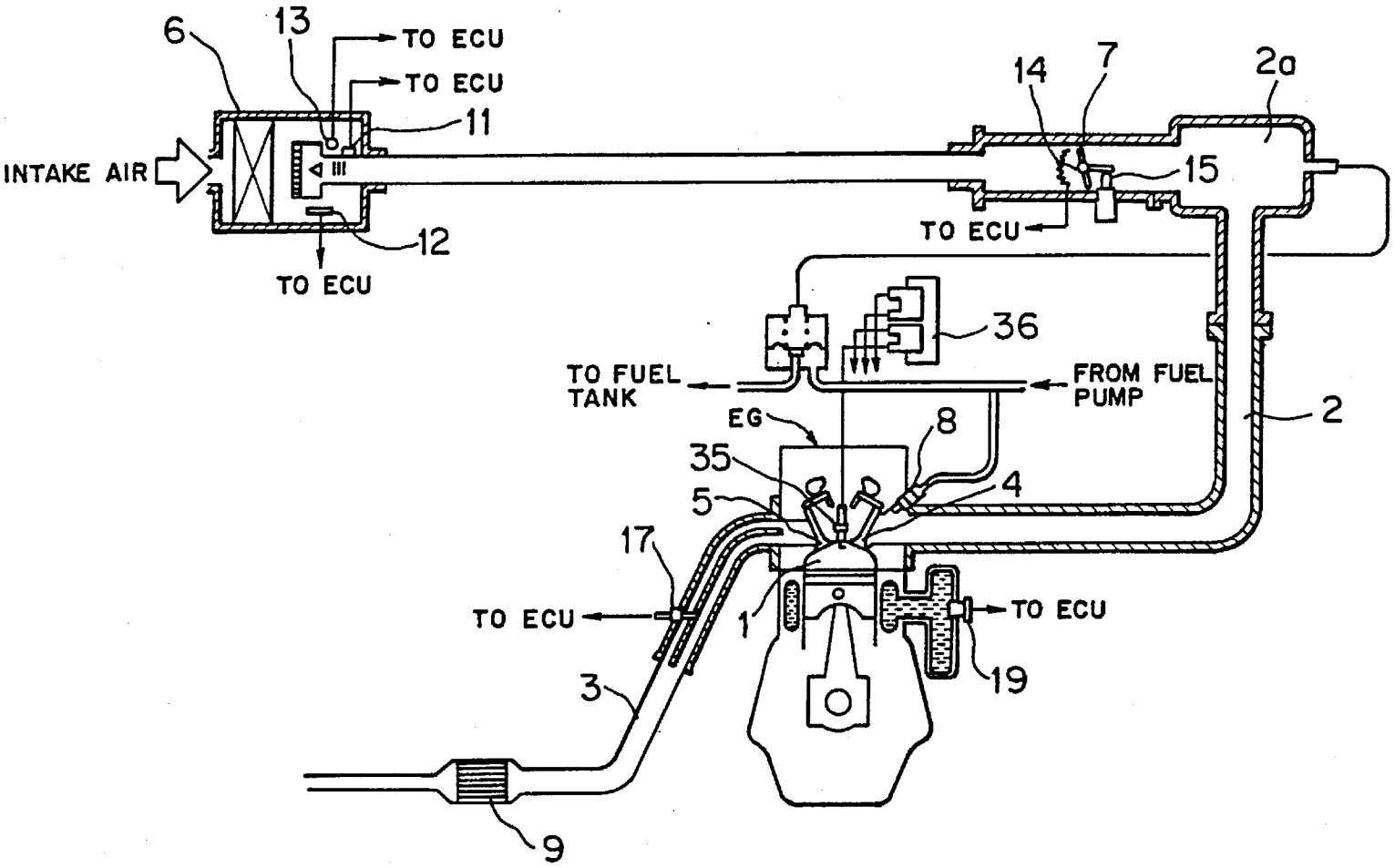
FIG. 3 is an overall construction diagram of an engine system equipped with the fuel feed control system of the embodiment.

The engine system equipped with the fuel feed control system is illustrated as shown in FIG. 3. In FIG. 3, an engine (internal combustion engine) EG has an intake passage 2 and exhaust passage 3 extending to a combustion chamber 1. The intake passage 2 and the combustion chamber 1 are communicated with each other under control by an intake valve 4, whereas the exhaust passage 3 and the intake chamber 1 are communicated with each other under control by an exhaust valve 5.

The intake passage 2 is provided with an air cleaner 6, a throttle valve 7 and as fuel feeding means, an electromagnetic fuel injection valve (injector) 8, which are arranged one after another from an upstream side. The exhaust passage 3, on the other hand, is provided with an exhaust-gas cleaning catalytic converter (3-way catalyst) 9 and an unillustrated muffler (noise deadening device), which are disposed one after the other from an upstream side. A surge tank 2*a* is also arranged in the intake passage 2.

The number of injectors 8 equals the number of cylinders arranged in an intake manifold section of the engine EG. Now assuming that the engine EG is an in-series 4-cylinder engine, four injectors 8 are arranged. The engine EG can therefore be considered as a so-called multi-cylinder engine of the multipoint fuel injection (MPI) system.

Further, the throttle valve 7 is connected to an accelerator pedal via a wire cable, whereby the opening of the throttle valve varies depending on the stroke of the accelerator pedal. The throttle valve 7 is also designed to be driven, that is, to be opened or closed by an idling speed control motor (ISC motor), so that the opening of the throttle valve 7 can be changed even if the accelerator pedal is not depressed during idling.

Owing to the construction described above, air inducted through the air cleaner 6 in accordance with the opening of the throttle valve 7 is mixed with fuel from the injector 8 within the intake manifold so that an appropriate air/fuel ratio is achieved. By causing a spark plug 35 to form a spark at a desired timing in the combustion chamber 1 through an ignition coil 36, the fuel is caused to burn to produce an engine torque. The resulting gaseous mixture is exhausted as exhaust gas into the exhaust passage 3. Subsequent to purification of three noxious components, CO, HC and NOx, in the exhaust gas through the catalytic converter 9, the exhaust gas is deadened in noise and then released into the atmosphere.

A variety of sensors are also arranged to control the engine EG. First, on a side of the intake passage 2, an air flow sensor (inducted air quantity sensor) 11 for detecting the quantity of inducted air, an intake air temperature sensor 12 for detecting the temperature of inducted air and an atmospheric sensor 13 for detecting the atmospheric pressure are arranged in a section where the air cleaner 6 is disposed and, further, a throttle position sensor 14 of the potentiometer type for detecting the opening of the throttle valve 7, an idling switch 15 for detecting an idling state, and the like are arranged in a section where the throttle valve 7 is disposed.

On a side of the exhaust passage 3, on the other hand, an oxygen concentration sensor 17 (hereinafter simply called the "$O_2$ sensor 17") for detecting the concentration of oxygen (the $O_2$ concentration) in exhaust gas is arranged on an upstream side of the catalytic converter 9.

Figure 2:
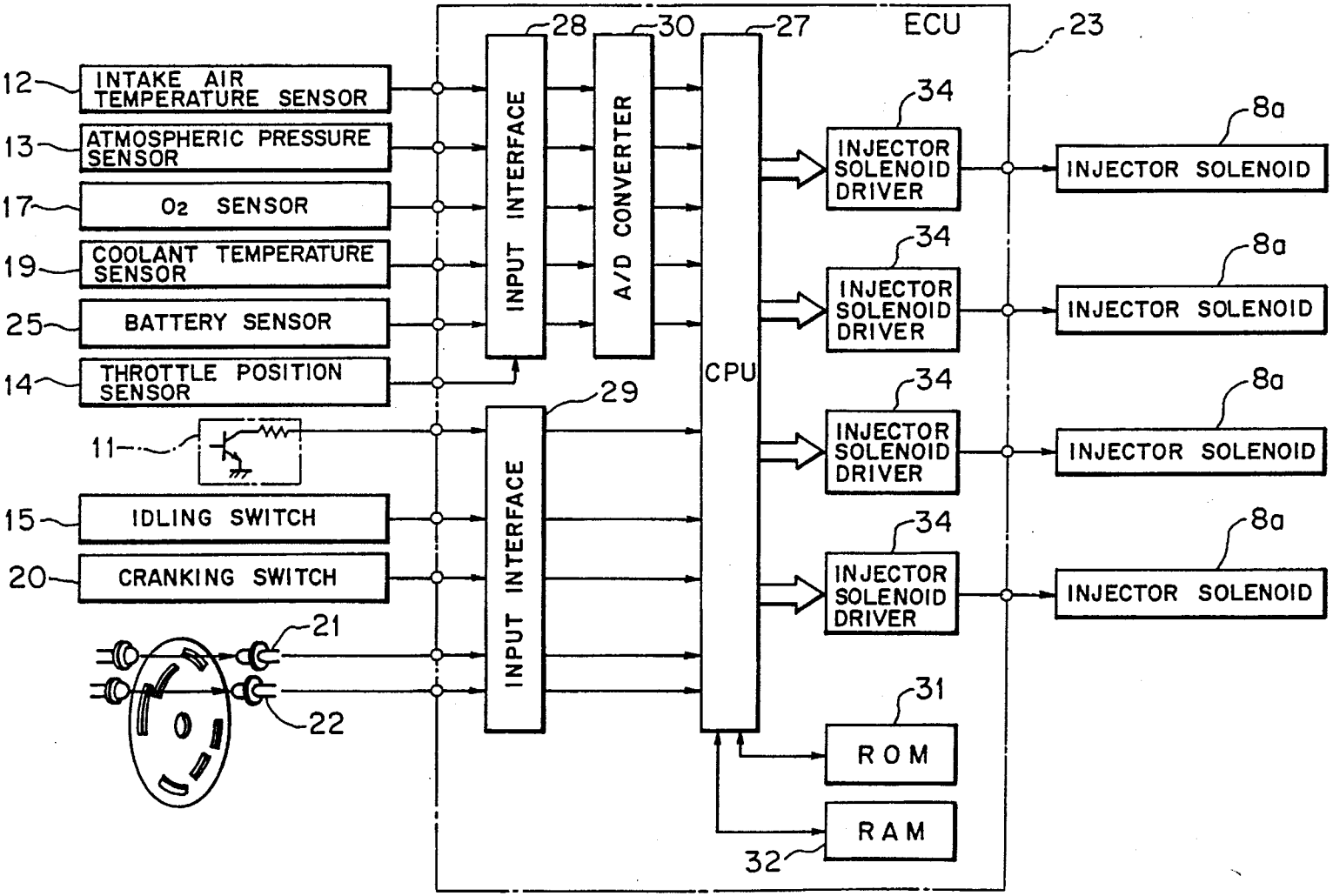
FIG. 2 is a hardware block diagram of the control unit in the fuel feed control system of the embodiment.

Arranged as other sensors in a distributor include a coolant temperature sensor 19 for detecting the temperature of an engine coolant and as shown in FIG. 2, a crank angle sensor 21 for detecting a crank angle (which also serves as an engine speed sensor for detecting the revolution speed of the engine) and a TDC sensor (cylinder sensor) 22 for detecting the top dead center of the first cylinder (base cylinder).

Detection signals from these sensors are inputted to an electronic control unit (ECU) 23.

Also inputted to ECU 23 are a voltage signal from a battery sensor 25 for detecting the voltage of a battery and a signal from a cranking switch 20 or an ignition switch (key switch) for detecting a startup.

Incidentally, the hardware construction of ECU 23 can be illustrated as shown in FIG. 2. ECU 23 is provided with CPU (processor) 27 as a principal component thereof. To CPU 27, detection signals from the intake air temperature sensor 12, the atmospheric pressure sensor 13, the throttle position sensor 14, the $O_2$ sensor 17, the coolant temperature sensor 19 and the battery sensor 25 are inputted via an input interface 28 and an A/D converter. Furthermore, detection signals from the air flow sensor 11, the crank angle sensor 21, the TDC sensor 22, the idling switch 15, the cranking switch 20, the ignition switch and the like are inputted via an input interface 29.

Through a bus, CPU 27 exchanges data with ROM 31, which stores program data and fixed value data RAM 32, whose data can be updated and changed at any time, and RAM (not illustrated) backed up by the battery while connected to the battery so that its stored contents are retained.

Incidentally, the data of RAM 32 are cleared and reset when the ignition switch is turned off.

Further, fuel injection control signals produced based on the results of computation by CPU 27 are outputted to solenoids (injector solenoids) 8*a* (precisely, transistors for the injector solenoids 8*a*) of the respective injectors 8 via four injector solenoid drivers 34.

Figure 1:
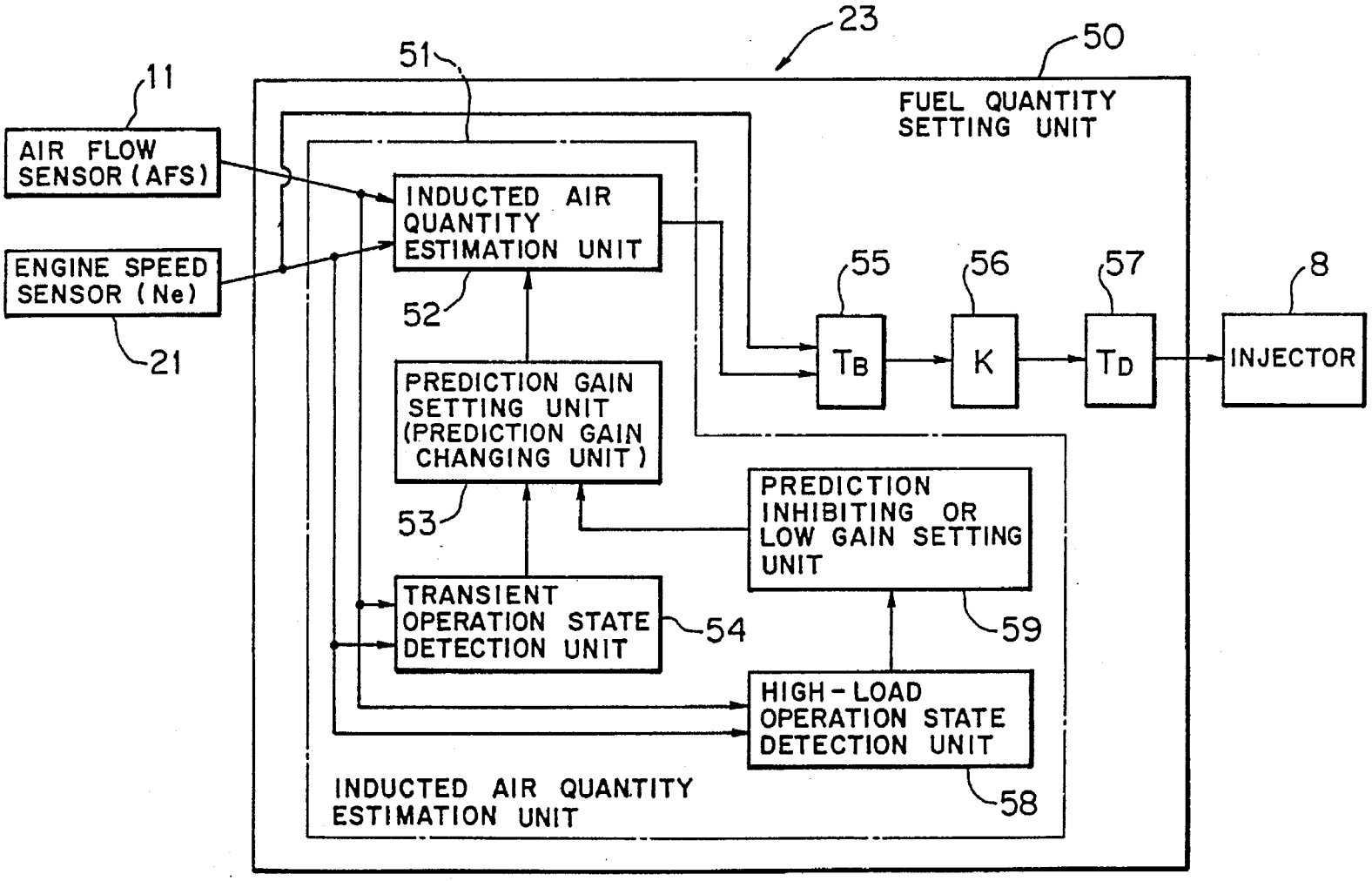
FIG. 1 is a block diagram of a fuel feed control system according to one embodiment of the present invention for an internal combustion engine, in which an emphasis is placed on functions of its control unit.

Now paying attention to functions for performing fuel injection control (air/fuel ratio control) of the engine EG, to conduct the fuel injection control (injector drive time control), ECU 23 is provided as shown in FIG. 1 with fuel quantity setting unit 50 for setting the quantity of fuel to be injected through each injector 8. Based on inducted air quantity information detected at an inducted air quantity detection time before the end of the induction stroke, this fuel quantity setting unit 50 sets the quantity of fuel to be fed at a desired fuel feeding time in an induction stroke and is means corresponding to CPU 27 depicted in FIG. 2.

It is for the below-described reason that at the fuel quantity setting unit 50, the quantity of fuel to be fed is set using the inducted air quantity information before the end of the induction stroke. Needless to say, it is desired to set the quantity of fuel, which is to be fed to each injector 8, in accordance with the quantity of air inducted at the time of every injection of fuel. It is however very difficult to accurately measure the quantity of air inducted in a given induction stroke, to set a quantity of fuel corresponding to the quantity of inducted air and then to feed fuel into the combustion chamber 1 concurrently with induction of air. The present control system is therefore designed to set the quantity of fuel on the basis of information on the quantity of air inducted in an induction stroke before a given induction stroke.

Further, as is shown in FIG. 1, the fuel quantity setting unit 50 is also provided with inducted air quantity estimation unit 51. This inducted air quantity estimation unit 51 estimates the quantity of air, which is to be inducted at the time of feeding of fuel, on the basis of the result of detection of an inducted air quantity at the inducted air quantity detection time and a value obtained by incorporating predicted information into the difference between the result of the detection of the inducted air quantity and inducted air quantity information detected before the inducted air quantity detection time.

In addition, this inducted air quantity estimation unit 51 is provided with an induction air quantity estimation unit 52, a prediction gain setting unit (prediction gain changing unit) 53 as the predicted information changing means, and a transient operation state detection unit 54. The inducted air estimation unit 52 is a part which functions as a main part of the inducted air estimation unit 51 and, when the operation state of the engine EG is in a transient state, the transient operation state detection unit 54 detects the transient operation state. Specifically, the transient operation state detection unit 54 detects from the quantity of a change in the A/N information whether the operation state of the engine EG is in acceleration or in deceleration. When the transient operation state of the engine EG is detected by the transient operation state detection unit 54, the prediction gain setting unit (prediction gain changing unit) 53 sets a prediction gain KF as predicted information by feedback control so that an estimated quantity of inducted air and a real quantity of inducted air become closer to each other.

At the inducted air quantity estimation unit 52, estimated inducted air quantity information is outputted based on the prediction gain KF from the prediction gain setting unit 53. This inducted air quantity estimation unit 51 will be described in detail subsequently herein.

On the other hand, the fuel quantity setting unit 50 is provided, beside the inducted air quantity estimation unit 51, with basic drive time determination unit 55 for determining a basic drive time $T_B$ of the injector 8 and correction coefficient setting unit 56 for setting a correction coefficient K. Also provided is dead time correction unit 57 for setting a dead time (inoperative time) $T_D$ to correct the drive time of the injector 8.

These unit 55, 56 and 57 will hereinafter be described in brief. The basic drive time determination unit 55 determines the quantity of air inducted per revolution of the crankshaft of the engine, that is, A/N information from information on the estimated quantity of inducted air from the inducted air estimation unit 51 and information on the engine speed N from the crank angle sensor (engine speed sensor) 21 and, by looking up or addressing a memory such as a map in accordance with this information, applies a suitable interpolating processing, whereby the basic drive time $T_B$ having a standard pulse width information is determined.

The correction coefficient setting unit 55 sets the correction coefficient K on the basis of the engine speed N, the engine load A/N and information from other sensors. The dead time correction unit 57 corrects the drive time in accordance with a voltage from an unillustrated battery.

At the fuel quantity setting unit 50, an injector drive time $T_{inj}$ is set by the following formula while using the basic drive time $T_B$, the correction coefficient K and the dead time $T_D$ which have been set by the above-described basic drive time determination unit 55, correction coefficient setting unit 56 and dead time correction unit 57, respectively.

$$T_{inj}=T_B\times K+T_D$$

Incidentally, the basic drive time determination unit 55 is provided with the map for the determination of the basic drive time $T_B$ so that from the information on the speed Ne of the engine EG and the information on the quantity of air inducted per revolution of the crankshaft of the engine, i.e., the A/N ratio, the basic drive time $T_B$ is determined in accordance with the map. As this A/N information, an estimated quantity of inducted air, A/NF(n), estimated by the inducted air quantity estimation unit 51 is used. The estimated quantity of inducted air, A/NF(n), is calculated in accordance with the following formula (1):

$$A/NF(n)=A/N(n)\pm KF\cdot[A/N(n)-A/N(n-1)] \quad (1)$$

where

A/NF(n): Estimated quantity of inducted air in the current control.

A/N(n): Real quantity of inducted air in the current control.

A/N(n−1): Real quantity of inducted air in the preceding control.

KF: Prediction gain as predicted information.

Namely, by adding to the real quantity of inducted air A/N(n), which has been measured by the air flow sensor 11 in a given induction stroke (the $n^{th}$) a value, a value obtained by multiplying with the gain KF the difference between the real quantity of inducted air A/N(n) and the real quantity of inducted air in the induction stroke ($n-1^{th}$) immediately before the given induction stroke, the estimated quantity of air to be inducted, for example, two strokes later, A/NF(n), is determined. It is however to be noted that the prediction gain KF does not take any negative value.

In the formula (1) described above, the detected quantity of inducted air in the current control, A/N(n), has been subjected to a primary filtering processing with respect to a detection value A/No(n) of the real quantity of inducted air detected by the air flow sensor and is calculated in accordance with the following formula:

$$A/N(n)=k\cdot A/N_o(n)+(1-k)[A/N_o(n)-A/N_o(n-1)]$$

where $0<k<1$.

When the above-described prediction gain KF is a variable gain which is changed depending on the state of operation of the engine EG and a transient operation state of the engine EG is detected by the transient operation state detection unit 54, the prediction gain KF is set as the predicted information at the prediction gain setting unit (prediction gain changing unit) 53 in the present control system so that the real quantity of inducted air and the estimated quantity of inducted air become closer to each other.

In the present control system, the drive time of the injector 8 is controlled, that is, the quantity of fuel to be injected is controlled by setting the basic drive time $T_B$ while using the estimated inducted air quantity A/NF(n) estimated by the inducted air quantity estimation unit 51.

The inducted air quantity estimation unit 51 will hereinafter be described in detail.

When a transient operation state of the engine EG is detected by the transient operation state detection unit 54, the prediction gain setting unit (prediction gain changing unit) 53 changes the prediction gain KF by feedback control in accordance with the estimated quantity of inducted air and the real quantity of inducted air.

Now assume that the quantity of air to be inducted 2 strokes later is estimated by the inducted air quantity estimation means 51 in the present embodiment. The inducted air quantity A/NF(n) which is estimated based on the values of the real quantities of inducted air, A/N(n) and A/N(n−1), obviously becomes an estimated value for the quantity of air to be inducted two strokes later. By comparing the value of the real quantity of inducted air A/N(n) with A/NF(n−2) estimated two strokes before and feeding back the result of the comparison (the difference), the prediction gain KF is hence modified (changed) stepwise.

This makes it possible to substantially eliminate the difference between the estimated quantity of inducted air and the real quantity of inducted air, thereby permitting estimation of an accurate quantity of inducted air.

When the difference [=A/N(n)−A/NF(n−2)] becomes smaller than a predetermined value upon changing the prediction gain KF by feeding back the difference between the estimated value of inducted air A/NF(n−2) and the real quantity of inducted air A/N(n), the prediction gain setting unit (prediction gain changing unit) 53 then subtracts a certain value stepwise from the prediction gain KF, that is, changes and corrects the prediction gain KF in a direction opposite to the direction of a preceding change and correction.

The predetermined value mentioned above is a dead band 102 ANDB which is set at the prediction gain setting unit (prediction gain changing unit) 53.

Although not illustrated in the drawing, this prediction gain setting unit 53 is provided with lower limit setting unit. This lower limit setting unit sets a lower limit (i.e., 102 KANFMIN to be described subsequently herein) of the prediction gain KF when the value of the prediction gain KF is changed based on the result of a comparison between the estimated quantity of inducted air A/NF(n−2) and the real quantity of inducted air A/N(n).

This lower limit setting unit sets as the lower limit a value in a range not greater than the number of detections of the quantity of inducted air between the inducted air quantity detection time and the fuel feeding time. Describing this by using a specific example, a delay of two strokes (360° in terms of the revolution angle of the crankshaft) occurs between the inducted air quantity detection time and the fuel feeding time in the case of a 4-cylinder/4-cycle engine. During these two strokes, detection of a quantity of inducted air is performed with respect to two of the four cylinders. In such an engine, the lower limit is therefore set between 0 and the number of detections of the quantity of inducted air during these two strokes, that is, 2, for example, at 2 or a positive value smaller than 2.

Although not illustrated in the drawing, the prediction gain setting unit 53 is also provided with upper limit setting unit. Contrary to the above-described lower limit setting unit, this upper limit setting unit sets an upper limit (102 KANFMAX) of the prediction gain KF. When the prediction gain KF exceeds the upper limit, the prediction gain KF is clipped at this upper limit. As a consequence, the changing of the prediction gain KF is promptly performed even when the operation state of the engine EG is changed from quick acceleration to quick deceleration.

The upper limit which is set by this upper limit setting unit is set at different values depending on whether the engine EG is in acceleration or in deceleration. In other words, the upper limit when the quantity of inducted air is leaning toward an increase is set equal to or greater than the upper limit when the quantity of inducted air is leaning toward a decrease. This makes it possible to set the upper limit of the prediction gain KF in accordance with the state of operation of the engine EG.

Incidentally, at the prediction gain setting unit 53, the prediction gain KF as predicted information is set, as an initial value, at a value greater than the number of detections of the quantity of inducted air between the inducted air detecting time and the fuel feeding time when a transient operation state of the engine EG is detected by the transient operation state detection unit 54. In the case of a 4-cylinder/4-cycle engine, a value greater than the number of detections of the quantity of inducted air, that is, 2 (for example a value of 4 or so) is therefore set as an initial value (i.e., 102 KFACC or 102 KFDEC to be described subsequently herein) of the prediction gain KF. In the case of a 6-cylinder/4-cycle engine, a value greater than the number of detections of the quantity of inducted air, that is, 3 (for example a value of 6 or so) is set as an initial value of the prediction gain KF.

After the initial value of the prediction gain KF has been set as described above, the value of the prediction gain KF is changed in accordance with the result of a comparison between the estimated quantity of inducted air A/NF(n−2) and the real quantity of inducted air A/N(n).

Upon setting the initial value of the prediction gain KF, this initial value may also be changed in accordance with at least one of the quantity and direction of a transient change of the engine EG. Described specifically, it is only necessary for this case to detect whether the direction of the transient change is an accelerating direction or a decelerating direction and then to set the initial value in accordance with the direction of the transient change.

The prediction gain changing unit 53 is designed in such a way that upon stepwise changing the prediction gain KF in a decreasing direction, the rate of a decrease is changed in at least two stages. When it is necessary to promptly decrease the prediction gain KF, the prediction gain KF is first decreased substantially at once and is then decreased stepwise gradually. This makes it possible to promptly decrease the prediction gain KF upon completion of an acceleration, during a deceleration or the like.

The inducted air quantity estimation unit 51 is also provided with high-load operation state detection unit 58 and prediction inhibiting or low gain setting unit 59. When the engine EG is in a high-load operation state, the high-load operation state detection unit 58 detects it on the basis of the A/N information.

When the high-load operation state (in or around a full throttling range) of the engine EG is detected by the high-load operation state detection unit 58, this information is transmitted to the prediction inhibiting or low gain setting unit 59. When the engine EG is in the high-load operation state, this prediction inhibiting or low gain setting unit 59 controls the prediction gain changing unit 53 to set the prediction gain KF at 0 so that prediction of a quantity of air to be inducted is inhibited or to set the prediction gain KF at a predetermined low value, for the reasons to be described next.

In a high-load operation state of the engine EG, an error tends to occur in the measurement value of an actual quantity of inducted air A/N due to pulsation in the inducted air, thereby making it difficult to obtain correct data. This is considered to result in an error in the prediction of a quantity of air to be inducted. On the other hand, the high-load operation state is in or around the full throttling range so that any further acceleration is rarely needed.

The fuel injection control including that for a transient operation state of the engine EG will hereinafter be described using the flow charts of FIG. 4 to FIG. 6.

By an SGT interruption, a real quantity of inducted air A/N(n) is first sampled in step SA1. The term "SGT interruption" means an interruption conducted in synchronization with the ignition timing of the engine EG. This SGT interruption is performed at predetermined crank angles.

After the real quantity of inducted air A/N(n) has been sampled in step SA1, the routine then advances to step SA2, where it is determined whether or not the real quantity of inducted air A/N(n) is smaller than a predetermined value 102 FANMAX. This predetermined value 102 FANMAX has been given as a value before the throttle opening of the engine EG is brought into a fully opened position. Where A/N(n) is equal to or greater than the predetermined value 102 FANMAX, the routine advances along the NO route to step SA3. In this step SA3, a flag for the estimation of an inducted air quantity is cleared and the prediction gain KF is set at 0 (KF=0). In other words, where A/N(n) is equal to or greater than the predetermined value 102 FANMAX, the throttle opening is determined close to the almost fully opened position and no estimation is performed with respect to the inducted air quantity. Namely, it is unnecessary to predict an inducted air quantity in such a high-load operation state that the sampled value A/N(n) exceeds the predetermined value 102 FANMAX. In step SA3, the prediction gain KF is therefore set at 0 (KF=0) to prohibit prediction of an inducted air quantity.

After that, the routine then advances to step SA14. As the prediction gain KF is 0 (KF=0), A/NF(n) is set at A/N(n).

If the real quantity of inducted air A/N(n) is found to be smaller than the predetermined value 102 FANMAX in step SA2, the routine then advances to step SA4, where the rate of a change in the inducted air quantity, ΔA/N, is calculated from the current real quantity of inducted air A/N(n) and a preceding real quantity of inducted air A/N(n−1).

In step SA5, it is next determined whether or not ΔA/N is equal to or greater than 0. Incidentally, positive ΔA/N indicates that the change in the inducted air quantity is leaning toward an increase, whereas negative ΔA/N indicates that the inducted air quantity tends to decrease.

Figure 5:
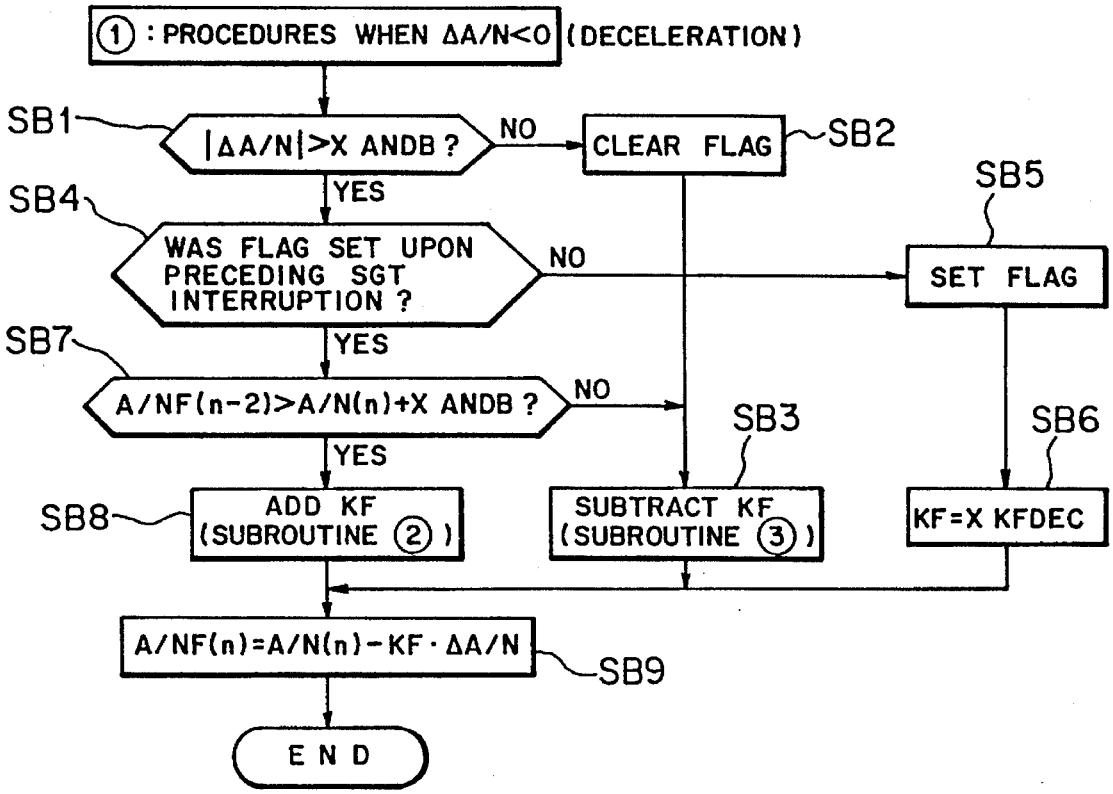
FIG. 5 is a flow chart of control procedures by the fuel feed control system of the embodiment.
Figure 6:
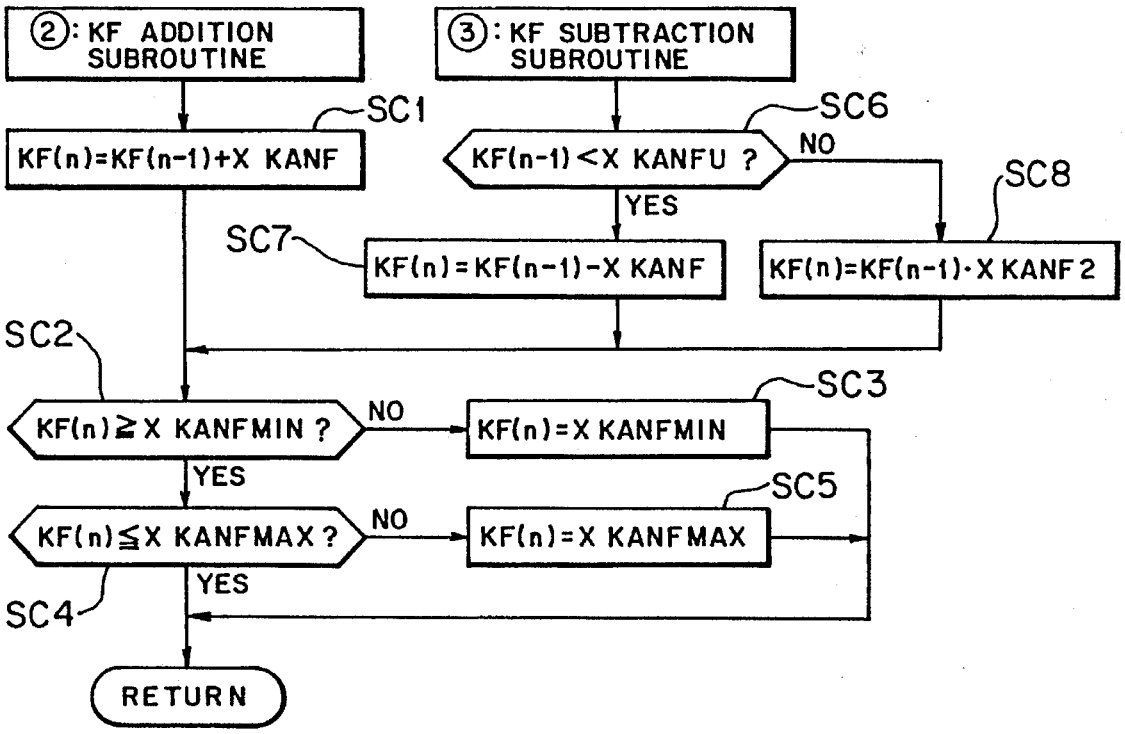
FIG. 6 is a flow chart of control procedures by the fuel feed control system of the embodiment.

If ΔA/N is negative, the routine advances to the subroutine shown in FIG. 5. This subroutine will be described subsequently herein.

If ΔA/N is equal to or greater than 0, in other words, the inducted air quantity is leaning toward an increase, the routine then advances to step SA6, where it is determined whether or not the value of ΔA/N is a value greater than a value 102 ANDB set at a dead zone. If ΔA/N is found to be equal to or smaller than 102 ANDB, the routine then advances to step SA7 and the flag is cleared. After the flag has been cleared there, the routine then advances to step SA8 and a predetermined value is subtracted from the value of a prediction gain KF. After step SA8, the control is performed following the subroutine shown in FIG. 6. This subroutine will also be described subsequently herein.

If the value of ΔA/N is found to be equal to or smaller than 102 ANDB in step SA6, the engine EG is in a steady-state operation (i.e., A/N is constant) so that prediction of a quantity of inducted air is not needed. During a slight acceleration of such an extent that the difference (ΔA/N) in A/N would not exceed the dead zone 102 ANDB, there is however the potential problem that fuel may not be supplied in a sufficient quantity due to a lag in the estimation of a quantity of air to be inducted. Accordingly, a minimum prediction is conducted in step SA8 by repeatedly subtracting the predetermined value from the value of the prediction gain KF.

If the value of ΔA/N is found to be greater than 102 ANDB in step SA6, the routine then advances to step SA9, where it is determined whether or not the flag for the estimation of an inducted air quantity was set in the preceding SGT interruption. If the flag is not found to have been set, the routine then advances to step SA10 to set the flag. Thereafter, the routine advances to step SA11, where an initial value of the prediction gain KF is set as 102 KFACC.

Namely, when the value of the preceding ΔA/N falls within the dead zone 102 ANDB (the flag is in a cleared state) and the value of the current ΔA/N is positive and greater than 102 ANDB, it is indicated that the operation state of the engine EG has changed abruptly. A transient operation state of the engine EG is therefore detected by the operation state detection unit 54. In the illustrated embodiment, the engine EG is determined to have initiated an acceleration so that the initial value of the prediction gain KF is set at a maximum value (102 KFACC).

This initial value 102 KFACC is set at a value greater than the number of detections of the inducted air quantity between the inducted air quantity detection time an the fuel feeding time. In the case of a 4-cylinder/4-cycle engine, a value greater than the number of detections of the inducted air quantity, that is, 2 (for example, a value of 4 or so) is set as 102 KFACC.

When the prediction gain KF has been set in step SA11, the routine then advances to step SA14, where an estimated quantity of air to be inducted is calculated in accordance with the following formula (2):

$$A/NF(n)=A/N(n)+KF\cdot\Delta A/N \quad (2)$$

If the flag is found to have been set in the preceding SGT interruption in step SA9, on the other hand, the routine then advances to step SA12, where it is determined whether or not the quantity of inducted air predicted this time, A/NF(n−2), is smaller than the difference between the current real quantity of inducted air A/N(n) and the dead zone 102 ANDB. Namely, it is determined in accordance with the following formula whether or not the estimated quantity of inducted air A/NF(n−2) is close to the real quantity of inducted air A/N(n):

$$A/NF(n-2)<A/N(n)-102\ ANDB$$

Where the above expression is not satisfied, in other words, the predicted quantity of inducted air A/NF(n−2) is greater, it is meant that the setting of the prediction gain KF is sufficient and that the predicted value has fetched up the real quantity of inducted air or the acceleration is about to come to an end. In this case, the routine advances to step SA8 so that a predetermined value is subtracted from the prediction gain KF. The routine then advances to step SA14, where the currently estimated quantity of inducted air, A/NF(n), is predicted based on the current real quantity of inducted air, A/N(n).

Where the above expression is satisfied, that is, the predicted quantity of inducted air A/NF(n−2) is smaller, on the other hand, it is meant that the setting of the prediction gain KF has not fetched up the acceleration of the engine EG. In this case, the routine then advances to step SA13, that is, to the subroutine in which a predetermined value is added to the prediction gain KF. This addition subroutine is designed as shown in FIG. 6 like the above-described subtraction routine in step SAS, and will also be described subsequently herein. The routine then advances to step SA14, where the currently estimated quantity of inducted air, A/NF(n), is predicted based on the current real quantity of inducted air, A/N(n).

As has been described above, in a transition period of acceleration of the engine EG, the prediction gain KF is updated based on the latest sample value [the actual value of inducted air, A/N(n)] and the quantity of inducted air predicted two strokes before, A/NF(n−2), whereby a currently predicted quantity of inducted air, A/NF(n), is predicted newly.

Another case in which ΔA/N is found to be negative in step SA5 will next be described in accordance with the subroutine shown in FIG. 5.

ΔA/N<0 means that the quantity of inducted air has been decreased. This in turn indicates that the engine EG is leaning toward a deceleration. In this case, the flow chart shown in FIG. 5 is followed to set a prediction gain KF corresponding to the degree of deceleration of the engine EG and then to estimate the quantity of air to be inducted.

When $\Delta A/N<0$, the routine then advances to step SB1, where it is determined whether or not this $|\Delta A/N|$ is greater than the dead zone 102 ANDB. If the value of $|\Delta A/N|$ is equal to or smaller than the dead zone 102 ANDB, the operation state of the engine EG is determined to be a steady state operation so that the routine advances to step SB2. After clearing the flag there, the routine advances to step SB3, that is, to a subroutine in which a predetermined value is subtracted from the prediction gain KF. This subtraction subroutine for the prediction gain KF is the same as the subtraction subroutine for the prediction gain KF in step SA8 in the flow chart shown in FIG. 4, and will be described subsequently herein.

The routine then advances to step SB9, where based on the current real quantity of inducted air, A/N(n), the current estimate quantity of inducted air, A/NF(n), is predicted in accordance with the following formula:

$$A/NF(n)=A/N(n)-KF\cdot\Delta A/N \quad (3)$$

Next, if $|\Delta A/N|$ is determined to be greater than the dead zone 102 ANDB in step SB1, the engine EG is determined to be in a transient state toward a deceleration. The routine hence advances to step SB4, where it is determined whether or not the flag for the estimation of a quantity of inducted air was set in the preceding SGT interruption.

If the flag is not found to have been set, the routine then advances to step SB5 to set the flag. The routine then advances to step SB6, where as an initial value of the prediction gain KF, 102 KFDEC is set. Incidentally, the gain value 102 KFDEC set at this time is a sufficiently large value and, like the above-described initial value 102 KFACC set in step SA11, a value greater than the number of detections of the inducted air quantity between the inducted air quantity detection time and the fuel feeding time (for example, a value around 4) is set. The routine then advances to step SB9, where the estimated quantity of inducted air A/NF(n) is predicted in accordance with the formula described above.

Where the flag has already been set, on the other hand, it is meant that the engine EG was also in a similar transient state at the time of the preceding SGT interruption, namely, the transient state has been continuing. In this case, the routine advances from step SB4 to step SB7, where it is determined in accordance with the below-described formula whether or not the estimated quantity of inducted air A/NF(n−2) is close to the real quantity of inducted air A/N(n). This corresponds to the determination of a transient period of acceleration in step SA12 in FIG. 4. In this step SB7, the determination is made to stepwise change (correct) the prediction gain KF for a transient period of deceleration.

$$A/NF(n-2)>A/N(n)+102\ ANDB$$

Where the above expression is not satisfied, in other words, the predicted quantity of inducted air A/NF(n−2) is smaller, it is meant that the setting of the prediction gain KF is sufficient and that the predicted value has fetched up the real quantity of inducted air or the deceleration is about to come to an end. In this case, the routine advances to step SB3 so that a predetermined value is subtracted from the prediction gain KF. The routine then advances to step SB9, where the currently estimated quantity of inducted air, A/NF(n), is predicted based on the current real quantity of inducted air, A/N(n).

Where the above expression is satisfied, that is, the predicted quantity of inducted air A/NF(n−2) is greater, on the other hand, it is meant that the setting of the prediction gain KF has not fetched up the deceleration of the engine EG. In this case, the routine then advances to step SB5, that is, to the subroutine in which a predetermined value is added to the prediction gain KF. This addition subroutine is designed as shown in FIG. 4 like the above-described addition subroutine in step SA13, and will also be described subsequently herein. The routine then advances to step SB9, where the currently estimated quantity of inducted air, A/NF(n), is predicted based on the current real quantity of inducted air, A/N(n).

As has been described above, in a transition period of deceleration of the engine EG, the prediction gain KF is also updated as KF(n) based on the latest sample value [the actual value of inducted air, A/N(n)] and the quantity of inducted air predicted two strokes before, A/NF(n−2), whereby a currently predicted quantity of inducted air, A/NF(n), is predicted newly.

Figure 4:
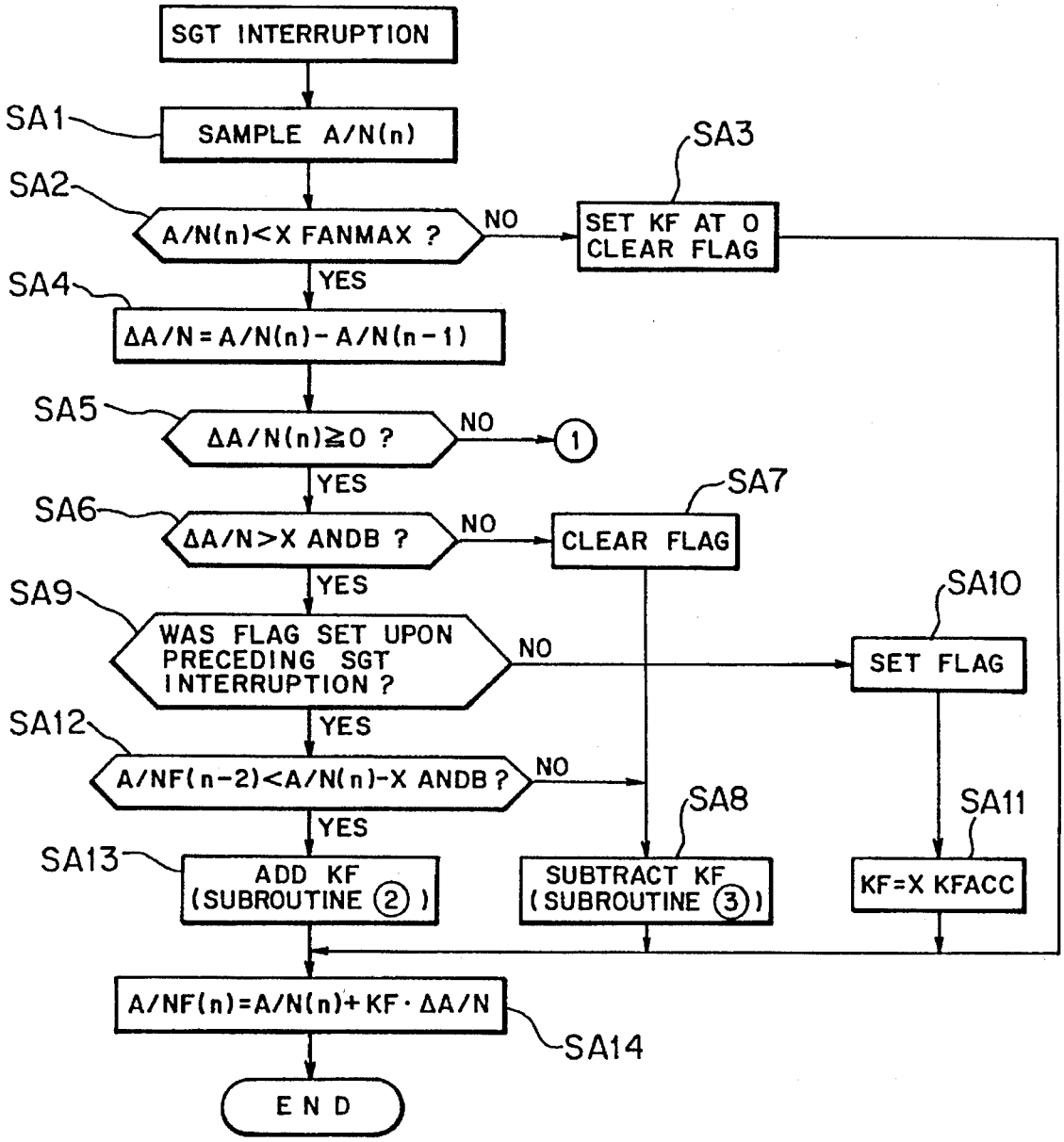
FIG. 4 is a flow chart of control procedures by the fuel feed control system of the embodiment.

The changing of the prediction gain KF and the associated prediction of the quantity of inducted air A/NF(n) have been described roughly by using the flow charts of FIG. 4 and FIG. 5. With respect to the subroutine for actually changing the prediction gain KF stepwise by adding or subtracting the predetermined value to or from the prediction gain KF, a description will hereinafter be made using the flow chart of FIG. 6.

First, a description will be made of the case in which the routine has advanced to the addition subroutine for the prediction gain KF in step SA8 (see FIG. 4) or step SB3 (see FIG. 5).

In the addition subroutine for the prediction gain KF, a current prediction gain KF(n) is first set in accordance with the following formula (4) in step SC1.

$$KF(n)=KF(n-1)+102\ KANF \quad (4)$$

Namely, a value which has been obtained by adding the predetermined value 102 KANF to the prediction gain KF(n−1) set upon the preceding interruption is set as the current prediction gain KF(n).

The routine then advances to step SC2, where it is determined whether or not the value of the prediction gain KF(n) set in step SC1 is equal to or greater than a lower limit 102 KFNFMIN of the prediction gain. When the gain KF(n) has a value smaller than the lower limit 102 KANFMIN, the routine advances to step SC3 so that KF(n) is set at 102 KANFMIN [KF(n)=102 KANFMIN]. As a result, KF(n) is clipped at the lower limit 102 KANFMIN.

In other words, when KF(n)<102 KANFMIN is found in step SC2, the prediction gain KF is clipped at the lower limit 102 KANFMIN in step SC3 so that the prediction gain KF will not become smaller than the lower limit 102 KANFMIN. The routine thereafter returns.

If KF(n)≧102 KANFMIN in step SC2, the routine then advances to step SC4 to determine whether KF(n)≦102 KANFMAX. Here, the predetermined value 102 KANFMAX is a value set as an upper limit of the prediction gain.

If KF(n) is found to be a value equal to or greater than the upper limit 102 KANFMAX, the routine then advances to step SC5 and KF(n) is set at 102 KANFMAX [KF(n)=102 KANFMAX]. As a result, KF(n) is clipped at the upper limit 102 KANFMAX.

If KF(n)≦102 KANFMAX in step SC4, the routine returns immediately.

When setting the prediction gain KF, the prediction gain KF(n) is updated basically by the processing as described above; namely, the predetermined value 102 KANF is added to the predicted gain KF(n−1) set in the preceding control. Only when the prediction gain KF(n−1) does not fall between the lower limit 102 KANFMIN and the upper limit 102 KANFMAX, despite the above processing, is the prediction gain KF(n) set at either the lower limit 102 KANFMIN or the upper limit 102 KANFMAX.

A description will next be made of the case where the control has advanced to the subtraction subroutine for the prediction gain KF in step SA8 (see FIG. 4) or step SB3 (see FIG. 5). As is illustrated in FIG. 6, it is first determined in step SC6 whether or not the preceding prediction gain KF(n−1) is smaller than a predetermined value 102 KANFU. This predetermined value 102 KANFU is set between the above-described lower limit 102 KANFMIN and upper limit 102 KANFMAX.

The routine then advances to step SC6. If KF(n−1) is greater than the predetermined value 102 KANFU, the routine then advances to step SC8 and the current prediction gain KF(n) is set in accordance with the following formula (5):

$$KF(n)=KF(n-1)\cdot \mathrm{KANF2} \tag{5}$$

Incidentally, 102 KANF2 is a predetermined value set between 0 and 1. Accordingly, where KF(n−1) is greater than the predetermined value 102 KANFU, the current prediction gain KF(n) is promptly set at a small value. The routine then advances to step SC2. Processing in step SC2 onwards is the same as the processing in the corresponding steps in the addition subroutine described above.

When the preceding prediction gain KF(n−1) is found to be smaller than the predetermined value 102 KANFU in step SC6, the routine then advances to step SC7 to set a current prediction gain KF(n) in accordance with the following formula (6):

$$KF(n)=KF(n-1)-102\ KANF \tag{6}$$

Incidentally, 102 KANF is a predetermined value and is equal to the predetermined value set out above with respect to the formula (4) described above (see step SC1). Thereafter, the processing in step SC2 onwards is applied.

As has been described above, the prediction gain KF(n−1) is compared with the predetermined value 102 KANFU in the subtraction subroutine in the present control system. If the prediction gain KF(n−1) is greater, KF(n−1) is multiplied by the predetermined value 102 KANF2 which falls between 0 and 1, thereby promptly setting KF(n) at a smaller value. When KF(n) becomes smaller than the predetermined value 102 KANFU, 102 KANF is then subtracted stepwise from KF(n−1) so that the prediction gain KF is gradually set to a smaller value.

This has made it possible to set the prediction gain KF without delay and hence to more accurately perform the estimation of a quantity of air to be inducted, even when the engine EG is in a transition period of a quick deceleration or acceleration.

Since the fuel feed control system according to the one embodiment of the present invention for the internal combustion engine is constructed as described above, a detected value of the quantity of inducted air is compared with a value of the quantity of air to be inducted. The latter value has been estimated two strokes before by the inducted air quantity estimation unit 51 at the time of operation of the engine EG so that a prediction gain KF is set. Using this prediction gain KF, the quantity of air to be inducted, A/N, upon injection of fuel is then predicted. This change to the prediction gain KF while making use of such feedforward (prediction or forecasting) and feedback control permits accurate prediction of the quantity of air to be inducted.

When A/N is estimated by the inducted air quantity estimation unit 51, the basic drive time $T_B$ for the injector 8 is determined by the basic drive time determination unit 55 on the basis of this A/N information and information from the engine speed sensor 21. A correction coefficient K and dead time $T_D$ are thereafter set by correction coefficient setting unit 56 and dead time correction unit 57, respectively, so that the drive time $T_{inj}$ for the injector 8 is determined in accordance with the formula, $T_{inj}=T_B\times K+T_D$. According to the present invention, the quantity of air to be inducted upon injection of fuel, A/N, is estimated using the prediction gain KF which is changed by the feedback control. This has made it possible to substantially eliminate the difference between a real quantity of inducted air and a corresponding estimated quantity of air to be inducted.

Figure 7:
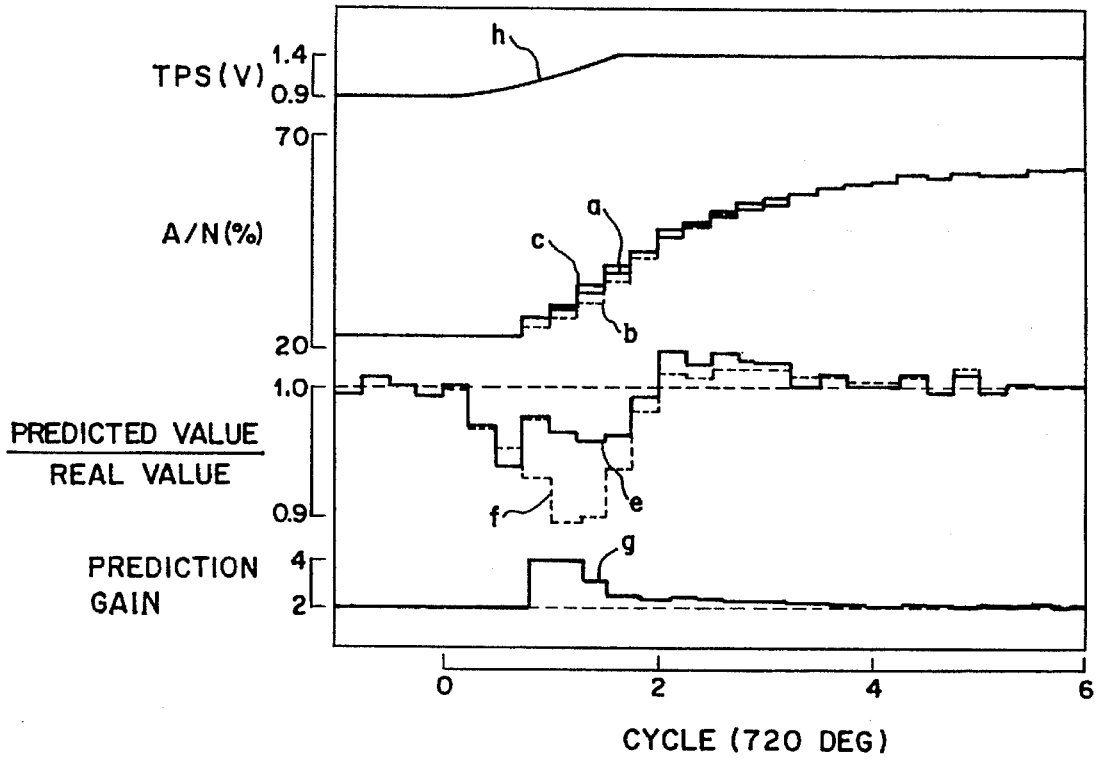
FIG. 7 is a graph for specifically describing advantageous effects of the fuel feed control system of the embodiment.

With reference to FIG. 7, estimated quantities of air to be inducted, as obtained in accordance with the present invention, will now be compared with corresponding real quantities of inducted air. A line a indicates estimated quantities of air to be inducted, as obtained using the variable prediction gain in the present invention. A line b indicates estimated quantities of air to be inducted, as obtained by setting the prediction gain at a fixed value (2 in this case) as in the conventional art. A line c indicates the values of real quantities of inducted air.

In the graph, lines e and f both indicate ratios of the estimated quantities of air to be inducted to the corresponding real quantities of inducted air, and a line e represents ratios of estimated quantities of air to be inducted, as obtained using the variable prediction gain, to the corresponding real quantities of inducted air. The closer to 1 the value of each ratio, the closer to the corresponding real quantity of inducted air. Further, a line g indicates variations in the prediction gain while a line h represents throttle openings.

As is shown by the line a in FIG. 7, each quantity of air to be inducted, as estimated using the variable prediction gain, is close to the corresponding real quantity of inducted air indicated by the line c. It is therefore understood that the estimation of each quantity of air to be inducted is performed accurately. In contrast, each predicted quantity of air to be inducted, as obtained when the prediction gain is a fixed value, is substantially different from its corresponding real quantity of inducted air as is evident from a comparison between the line a and the line b.

Further, as is also appreciated from a comparison between the line e and the line f, the quantity of air to be inducted, as estimated by the present invention, is apparently closer to the real quantity of inducted air so that the quantity of air to be inducted is accurately estimated in the present invention. In the graph of variations in the prediction gain as indicated by the line g, a greater throttle opening (see the line h) is determined to be an acceleration so that the prediction gain KF is set at a large value by a single operation and the prediction gain is then gradually set smaller by feedback control.

By changing the prediction gain KF as described above, an error in the prediction of a quantity of air to be inducted can be reduced. In particular, an error in an initial stage of acceleration can be significantly reduced. Air/fuel ratio control by the prediction of quantities of air to be inducted can hence be rendered accurate, thereby making it possible to avoid misfire upon lean-burn operation.

Figure 8:
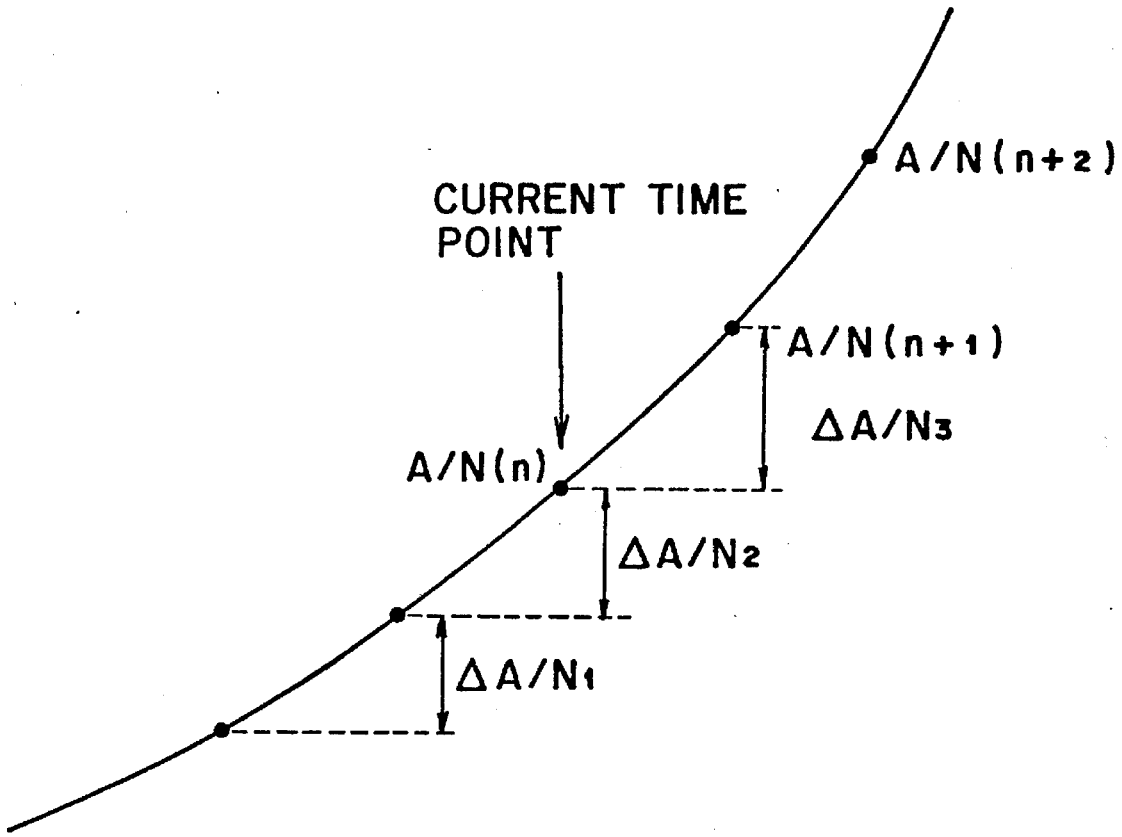
FIG. 8 is a graph for describing another example of estimation of the quantity of air, which is to be inducted, by the fuel feed control system of the embodiment.
Figure 9:
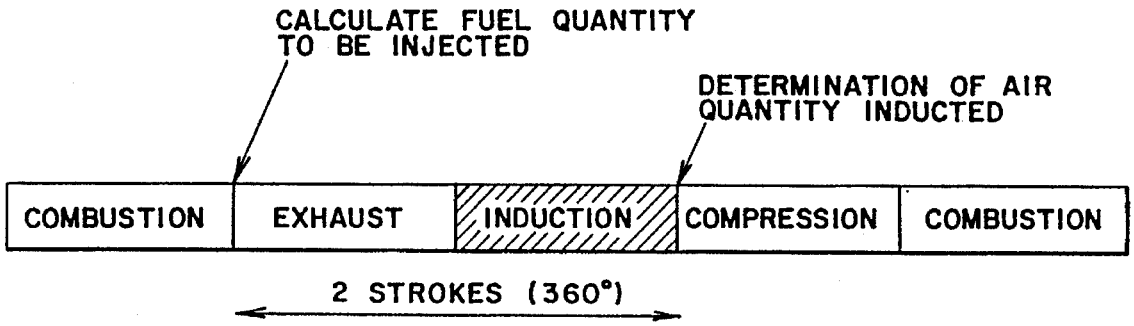
FIG. 9 is a schematic illustration showing a difference in time between the calculation time of the quantity of fuel to be injected and the determination time of the quantity of air inducted in a 4-cycle engine.
Figure 10:
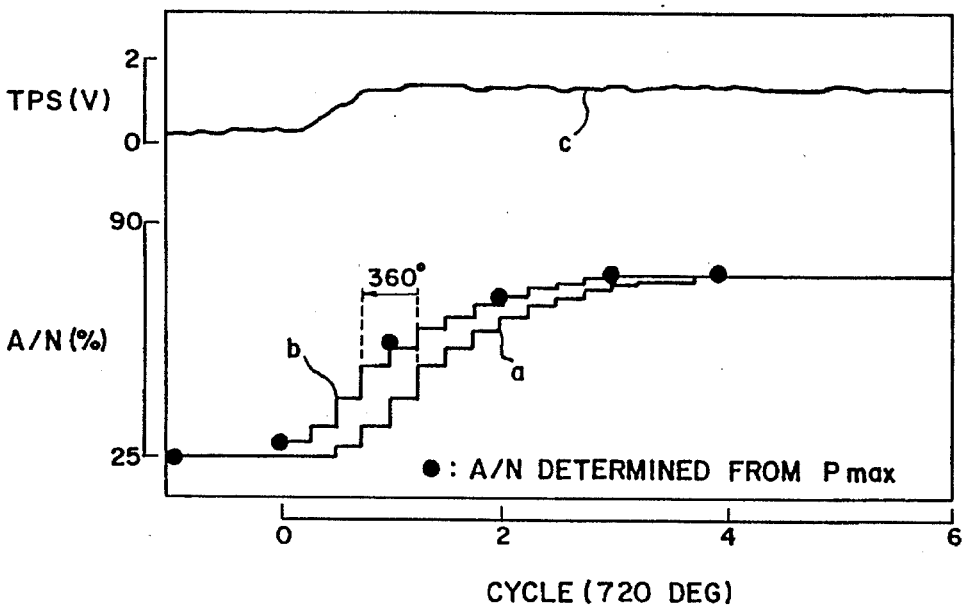
FIG. 10 is a graph showing differences between detected quantities of inducted air and corresponding real quantities of inducted air in the 4-cycle internal combustion engine.
Figure 11A:
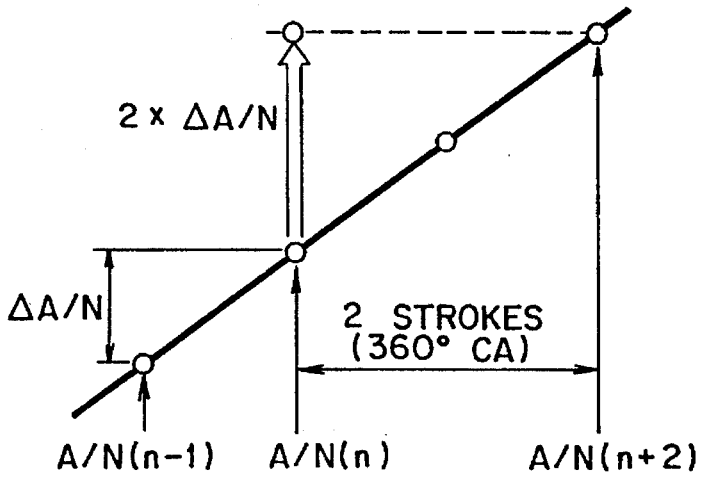
Figure 11B:
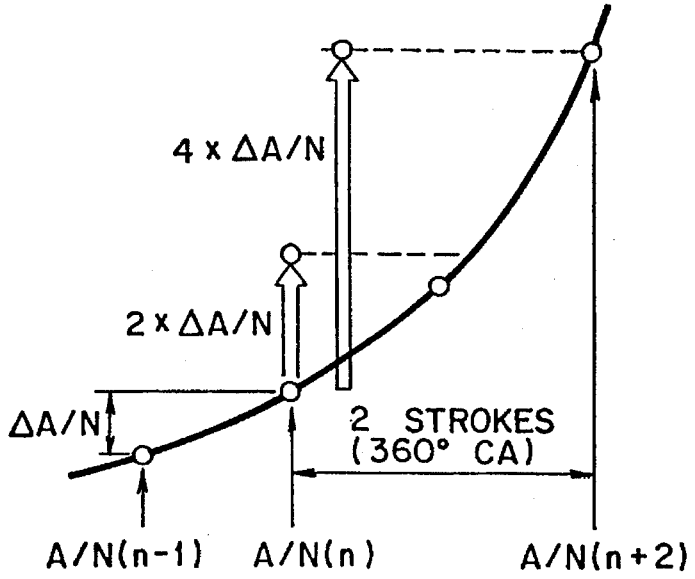

According to the present control system, it is also possible, as shown in FIG. 8, to predict the quantity of air to be inducted in the control after the next control, namely, in the (n+2)th control on the basis of information on a change in the changing rate of the quantity of inducted air.

Representing the quantity of air inducted in the current control by A/N(n), the quantity of air predicted to be inducted in the next control by A/N(n+1), and the quantity of air predicted to be inducted in the control after the next control by A/N(n+2), the quantity of air predicted to be inducted in the next control, A/N(n+1), can be predicted in accordance with the following formula (7):

$$A/N(n+1)=G1\times(\Delta A/N2\Delta A/N1)+\Delta A/N2+A/N(n) \quad (7)$$

Here, as is shown in FIG. 8, ΔA/N2 is the quantity of a change in the inducted air between the current control and the preceding control whereas ΔA/N1 is the quantity of a change in the inducted air between the preceding control and the control before the preceding control. Further, G1 is a prediction gain as predicted information.

In this formula (7), G1×(ΔA/N2−ΔA/N1) is the quantity of the change between A/N(n+1) and A/N(n) and is now represented by ΔA/N3, namely, $$\Delta A/N3=G1\times(\Delta A/N2-\Delta A/N1)+\Delta A/N2 \quad (7')$$

Based on this A/N(n+1), A/N(N+2) is next predicted in accordance with the following formula (8):

$$A/N(n+2)=G1\times(\Delta A/N2-\Delta A/N1)+A/N3+A/N(n+1) \quad (8)$$

Here, substitution of the formula (7') into the formula (8) gives:

$$A/N(n+2)=2G1\times(\Delta A/N2-\Delta A/N1)+\Delta A/N2+A/N(n+1)$$

Further, substituting the formula (7) into the above formula results in, $$A/N(n+2)=3G1\times(\Delta A/N2\Delta A/N1)+2\Delta A/N2+A/N(n)$$

such that A/N(n+2) can therefore be predicted.

By (1) adding the information on the changes in the changing rate of the quantity of inducted air in the preceding control and in the control before the preceding control (namely, the double derivative of the quantity of inducted air) to the actual quantity of air inducted in the current (nth) control and (2) upon detection of a transient operation state of the engine, changing the prediction gain G1 in such a way that an estimated quantity of air to be inducted and a corresponding real quantity of inducted air become closer to each other as described above, it is possible to conduct prediction of a quantity of air, which is to be inducted, in a manner surely reflecting even a sudden change in the operation state of the engine.

As the inducted air quantity information A/N, it is also possible to use that detected from information on the pressure of an intake passage.

The present embodiment has been described above primarily for the case that the control system is applied to an in-line 4-cylinder internal combustion engine. It is, however, to be noted that the present invention is not limited to internal combustion engines of such a type but can be applied to a wide variety of multi-cylinder internal combustion engines equipped with a multipoint injection system.

We claim:

1. A fuel feed control system for a multi-cylinder internal combustion engine, comprising:

fuel quantity setting means for setting a quantity of fuel to be fed at a desired fuel feeding time in an induction stroke of the internal combustion engine on the basis of inducted air quantity information detected at a desired inducted air quantity detection time before an end of the induction stroke, and means for feeding, at the desired fuel feeding time, fuel in the quantity set by the fuel quantity setting means;

wherein said fuel quantity setting means is provided with inducted air estimation means for estimating information on a quantity of air, which is to be inducted during the induction stroke corresponding to the desired fuel feeding time, on the basis of a result of detection of an inducted air quantity at the desired inducted air quantity detection time, inducted air quantity information detected before the desired inducted air quantity detection time and predicted information, and said inducted air estimation means is provided with transient operation state detection means for detecting a transient operation state of the internal combustion engine and predicted information changing means for changing the predicted information so that, upon detection of the transient operation state of the internal combustion engine by said transient operation state detection means, the estimated quantity of inducted air and a corresponding real quantity of inducted air become closer to each other.

2. A fuel feed control system according to claim 1, wherein said predicted information changing means comprises means for changing the predicted information in accordance with a result of a comparison between the estimated quantity of inducted air and the corresponding real quantity of inducted air upon detection of the transient operation state of the internal combustion engine by said transient operation state detection means.

3. A fuel feed control system according to claim 1, wherein said predicted information changing means comprises means for setting, as an initial value of the predicted information, a value greater than a number of detections of the quantity of inducted air between the desired inducted air quantity detection time and the desired fuel feeding time when the transient operation state of the internal combustion engine is detected by said transient operation state detection means.

4. A fuel feed control system according to claim 1, wherein said predicted information changing means comprises means for changing the predicted information in accordance with a result of a comparison between the estimated quantity of inducted air and the corresponding real quantity of the inducted air after a value greater than a number of detections of the quantity of inducted air between the desired inducted air quantity detection time and the desired fuel feeding time has been set as an initial value of the predicted information subsequent to detection of the transient operation state of the internal combustion engine by said transient operation state detection means.

5. A fuel feed control system according to claim 3, wherein said predicted information changing means comprises means for setting the initial value of the predicted information in accordance with at least one of a quantity and direction of a transient change of the internal combustion engine when the value greater than the number of detections of the quantity of inducted air between the desired inducted air quantity detection time and the desired fuel feeding time is set as the initial value of the predicted information upon detection of the transient operation state of the internal combustion engine by said transient operation state detection means.

6. A fuel feed control system according to claim 4, wherein said predicted information changing means comprises means for setting the initial value of the predicted information in accordance with at least one of a quantity and direction of a transient change of the internal combustion engine when the value greater than the number of detections of the quantity of inducted air between the desired inducted air quantity detection time and the desired fuel feeding time is set as the initial value of the predicted information upon detection of the transient operation state of the internal combustion engine by said transient operation state detection means.

7. A fuel feed control system according to claim 2, wherein said predicted information changing means comprises means for changing and correcting the predicted information in a direction opposite to the direction of a preceding change and correction when the difference between the corresponding real quantity of the inducted air and the estimated quantity of inducted air becomes smaller than a predetermined positive value upon changing the predicted information in accordance with the result of a comparison between the estimated quantity of inducted air and the corresponding real quantity of inducted air subsequent to the detection of the transient operation state of the internal combustion engine by said transient operation state detection means.

8. A fuel feed control system according to claim 1, wherein said predicted information changing means comprises means for stepwise changing a rate of decrease of the predicted information in at least two stages upon changing the predicted information in a decreasing direction.

9. A fuel feed control system according to claim 1, wherein said inducted air quantity estimation means comprises:

said transient operation state detection means;

means for detecting a high-load operation state of the internal combustion engine;

said predicted information changing means; and prediction inhibiting or low-gain setting means for setting the predicted information at 0 or at a predetermined low value and prohibiting the changing operation for the predicted information performed by said predicted information changing means when a high-load operation state of the internal combustion engine is detected by said high-load operation state detection means.

10. A fuel feed control system according to claim 2, wherein said predicted information changing means is provided with means for setting a lower limit of the predicted information so that the lower limit is varied depending on the result of the comparison between the estimated quantity of inducted air and the corresponding real quantity of inducted air, and said lower limit setting means comprises means for setting as the lower limit a value in a range not greater than a number of detections of the quantity of inducted air between the desired inducted air quantity detection time and the desired fuel feeding time.

11. A fuel feed control system according to claim 2, wherein said predicted information changing means is provided with means for setting an upper limit for the predicted information which varies depending on the result of the comparison between the estimated quantity of inducted air and the corresponding real quantity of inducted air.

12. A fuel feed control system according to claim 11, wherein said upper limit setting means sets the upper limit at different values depending on whether the internal combustion engine is in acceleration or in deceleration.

13. A fuel feed control system according to claim 1, wherein said inducted air estimation means estimates the inducted air quantity information at the desired fuel feeding time on the basis of the detection result of the quantity of inducted air at the desired inducted air quantity detection time and a value obtained by incorporating the predicted information into a difference between the detection result of the quantity of inducted air at the desired inducted air quantity detection time and the inducted air quantity information detected before the desired inducted air quantity detection time.

14. A fuel feed control system according to claim 1, wherein said inducted air estimation means estimates the inducted air quantity information during the induction stroke, corresponding to the desired fuel feeding time, on the basis of the detection result of the quantity of inducted air at the desired inducted air quantity detection time and a value obtained by incorporating the predicted information into a difference between plural pieces of information on changes in the quantity of inducted air detected before the desired inducted air quantity detection time.

15. A fuel feed control method for a multi-cylinder internal combustion engine, comprising:

(a) setting a quantity of fuel to be fed at a desired fuel feeding time in an induction stroke of the internal combustion engine on the basis of inducted air quantity information detected at a desired inducted air quantity detection time before an end of the induction stroke, and (b) feeding, at the desired fuel feeding time, fuel in the quantity set by the step (a);

wherein said step (a) estimates information on a quantity of air, which is to be inducted during the induction stroke corresponding to the desired fuel feeding time, on the basis of a result of detection of an inducted air quantity at the desired inducted air quantity detection time, inducted air quantity information detected before the desired inducted air quantity detection time and predicted information, and said step (a) includes the substeps of, (a1) detecting a transient operation state of the internal combustion engine, and (a2) changing the predicted information so that, upon detection of the transient operation state of the internal combustion engine by said step (a1), the estimated quantity of inducted air and a corresponding real quantity of inducted air become closer to each other.

16. A fuel feed control method according to claim 15, wherein said step (a2) changes the predicted information in accordance with a result of a comparison between the estimated quantity of inducted air and the corresponding real quantity of inducted air upon detection of the transient operation state of the internal combustion engine by said step (a1).

17. A fuel feed control method according to claim 15, wherein said step (a2) sets, as an initial value of the predicted information, a value greater than a number of detections of the quantity of inducted air between the desired inducted air quantity detection time and the desired fuel feeding time when the transient operation state of the internal combustion engine is detected by said step (a1).

18. A fuel feed control method according to claim 15, wherein said step (a2) changes the predicted information in accordance with a result of a comparison between the estimated quantity of inducted air and the corresponding real quantity of the inducted air after a value greater than a number of detections of the quantity of inducted air between the desired inducted air quantity detection time and the desired fuel feeding time has been set as an initial value of the predicted information subsequent to detection of the transient operation state of the internal combustion engine by said step (a1).

19. A fuel feed control method according to claim 17, wherein said step (a2) sets the initial value of the predicted information in accordance with at least one of a quantity and direction of a transient change of the internal combustion engine when the value greater than the number of detections of the quantity of inducted air between the desired inducted air quantity detection time and the desired fuel feeding time is set as the initial value of the predicted information upon detection of the transient operation state of the internal combustion engine by said step (a1).

20. A fuel feed control method according to claim 18, wherein said step (a2) sets the initial value of the predicted information in accordance with at least one of a quantity and direction of a transient change of the internal combustion engine when the value greater than the number of detections of the quantity of inducted air between the desired inducted air quantity detection time and the desired fuel feeding time is set as the initial value of the predicted information upon detection of the transient operation state of the internal combustion engine by said step (a1).

21. A fuel feed control method according to claim 16, wherein said step (a2) changes and corrects the predicted information in a direction opposite to the direction of a preceding change and correction when the difference between the corresponding real quantity of the inducted air and the estimated quantity of inducted air becomes smaller than a predetermined positive value upon changing the predicted information in accordance with the result of a comparison between the estimated quantity of inducted air and the corresponding real quantity of inducted air subsequent to the detection of the transient operation state of the internal combustion engine by said step (a1).

22. A fuel feed control method according to claim 15, wherein said step (a2) stepwise changes a rate of decrease of the predicted information in at least two stages upon changing the predicted information in a decreasing direction.

23. A fuel feed control system according to claim 15, wherein said step (a) further includes the substeps of, (a3) detecting a high-load operation state of the internal combustion engine;

(a4) setting the predicted information at 0 or at a predetermined low value when a high-load operation state of the internal combustion engine is detected by said step (a3); and (a5) prohibiting the changing operation for the predicted information performed by said step (a2) when a high-load operation state of the internal combustion engine is detected by said step (a3).

24. A fuel feed control method according to claim 16, wherein said step (a2) sets a lower limit of the predicted information so that the lower limit is varied depending on the result of the comparison between the estimated quantity of inducted air and the corresponding real quantity of inducted air, and sets as the lower limit a value in a range not greater than a number of detections of the quantity of inducted air between the desired inducted air quantity detection time and the desired fuel feeding time.

25. A fuel feed control method according to claim 16, wherein said step (a2) sets an upper limit for the predicted information which varies depending on the result of the comparison between the estimated quantity of inducted air and the corresponding real quantity of inducted air.

26. A fuel feed control method according to claim 25, wherein said step (a2) sets the upper limit at different values depending on whether the internal combustion engine is an acceleration or in deceleration.

27. A fuel feed control method according to claim 15, wherein said step (a) estimates the inducted air quantity information at the desired fuel feeding time on the basis of the detection result of the quantity of inducted air at the desired inducted air quantity detection time and a value obtained by incorporating the predicted information into a difference between the detection result of the quantity of inducted air at the desired inducted air quantity detection time and the inducted air quantity information detected before the desired inducted air quantity detection time.

28. A fuel feed control method according to claim 15, wherein said step (a) estimates the inducted air quantity information during the induction stroke, including the desired fuel feeding time, on the basis of the detection result of the quantity of inducted air at the desired inducted air quantity detection time and a value obtained by incorporating the predicted information into a difference between plural pieces of information on changes in the quantity of inducted air detected before the desired inducted air quantity detection time.

* * * * *